United States Patent [19]

Lettine et al.

[11] 4,114,514

[45] Sep. 19, 1978

[54] OSCILLATING STEAM ENGINES

[76] Inventors: Howard J. Lettine; Anthony Lettine, both of R.D. 4, Box 352, Middletown, N.Y. 10940

[21] Appl. No.: 690,171

[22] Filed: May 26, 1976

[51] Int. Cl.[2] ..... F01B 15/06

[52] U.S. Cl. ..... 91/211; 92/126

[58] Field of Search ..... 91/211, 214, 212, 213

[56] References Cited

U.S. PATENT DOCUMENTS

| | | | |
|---|---|---|---|
| 26,853 | 1/1860 | Mackintosh et al. | 91/211 |
| 30,240 | 10/1860 | Otis | 91/211 |
| 242,851 | 6/1881 | Abbott | 91/211 |
| 448,917 | 3/1891 | Garland | 91/211 |
| 815,632 | 3/1906 | Pilling | 91/211 |
| 2,326,494 | 8/1943 | Ratzburg | 91/211 |

*Primary Examiner*—Paul E. Maslousky

[57] ABSTRACT

In its simplest form an oscillating steam engine is limited to low pressure operation by a spring or set screw holding the cylinder against a stationary valve plate. This invention features trunnions not rigidly connected to the oscillating cylinder and pressure equalizing cylinder, making possible a wide and rapid variation of steam pressure and temperature with minimal valve and pressure equalizing cylinder leakage and trunnion friction and misalignment. In a compound or multiple expansion engine, high pressure steam can be fed to the low pressure cylinder for starting the engine or for increasing the power output. Automatic condensate relief is also provided for without separate manually operated valves.

2 Claims, 2 Drawing Figures

OSCILLATING STEAM ENGINES

This invention relates to new and useful improvements in oscillating cylinder steam engines, more particularly oscillating cylinder steam engines using an external valve plate, and pressure equalizing cylinder.

In prior art the oscillating cylinder was held against the stationary valve plate by spring pressure or by a set screw, and in some engines a pressure equalizing cylinder.

Trunnions were rigidly attached to the oscillating cylinder and pressure equalizing cylinder plunger. Widly varying steam pressures and temperatures often caused valve, trunnion and pressure equalizing cylinder plunger misalignment, resulting in excessive trunnion friction and leakage from the valves and pressure equalizing cylinder.

One object of this invention is to overcome the aforementioned disadvantages of prior art devices by not having the trunnions rigidly connected to the oscillating cylinder and pressure equalizing cylinder plunger. This allows a wide and rapid variation in steam temperature and pressure, with minimal valve and pressure equalizing cylinder leakage, and trunnion friction and misalignment, allowing smooth throttling and compound multiple expansion cylinder arrangements.

Another object of this invention is to provide automatic condensate relief.

Still another object of this invention is to provide for operation from a tank of compressed air where the pressure would be high at the start and low at the end of operation.

These objects as well as other objects of the instant invention will become apparent after reading the following description in connection with the accompanying drawings in which.

Figure 1:
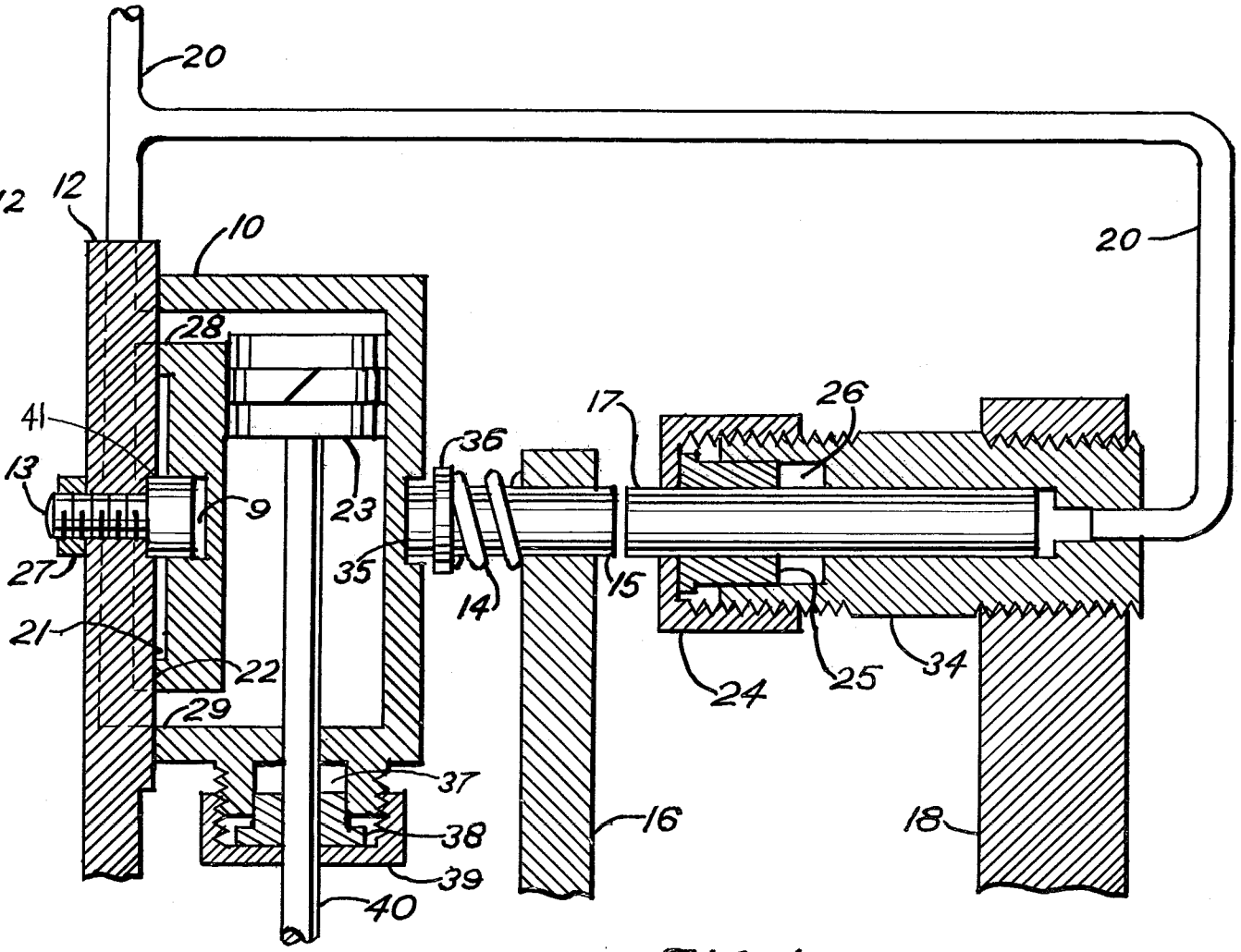
FIG. 1 is a section view of an oscillating cylinder engine with the pressure equalizing cylinder.
Figure 2:
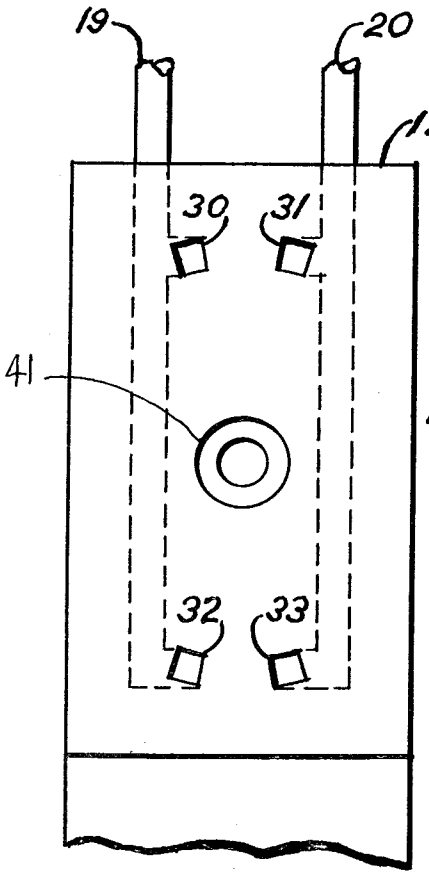
FIG. 2 is a front view of the stationary valve plate, showing the steam inlet and exhaust ports and connections.

All parts and structures in our oscillating engine model are metallic, except for the packings, which may be of any suitable material of a conventional nature.

Refering to the drawing in detail, an oscillating cylinder 10 with piston 23 bears on valve plate 12 mounted on the frame. Piston rod 40 connects to the crank connecting to the rotating shaft of the engine. Piston rod 40 is sealed by packing 37 held in place by packing gland 38 and packing nut 39. The oscillating cylinder 10 is supported by trunnions 13 and 15. Trunnion 13 is threadedly connected to valve plate 12 and locked by lock nut 27. Trunnion 15 is mounted in support plate 16 and held in place by spring 14. Steam is fed to valve plate 12 through steam pipe 20 and exhausts through steam pipe 19. Steam from steam pipe 20 enters the top of cylinder 10 through ports 31 and 28 when they are brought into communication, by the crank acting through the connecting rod, causing piston 23 to move downward. As piston 23 moves near its lowermost position in cylinder 10, the crank acts to pivot cylinder 10 on the trunnions to bring cylinder port 28 into communication with exhaust port 30, exhausting steam through exhaust pipe 19. At the same time, cylinder port 29 is brought into communication with steam port 33, causing steam to enter the cylinder and move piston 23 upward. As piston 23 nears its uppermost position in cylinder 10, the crank acts to pivot said cylinder, bringing ports 31 and 28 back into communication to repeat the cycle and create an oscillatng motion in the cylinder, as the crank and engine shaft rotate.

Steam from pipe 20 is also fed to pressure equalizing cylinder 34, mounted on support plate 18. This steam is at the same pressure and from the same source supplying oscillating cylinder 10. Steam in cylinder 34 forces plunger 17 against trunnion 15. No matter how high or low, the steam pressure is compensated by the force of plunger 17. The greater force of plunger 17 at high pressure eliminates external valve leakage. A reduction in force of plunger 17 at low pressure minimizes friction and valve wear. Cylinder 34 is sealed by packing 26, held in place by packing gland 25 and packing nut 24. Spring 14 holds oscillating cylinder 10 in place when there is no steam pressure, when the engine is not running or if balancing cylinder 34 is removed for servicing. Shoulder 36 on trunnion 15 prevents spring 14 from touching oscillating cylinder 10.

Pressure equalizing cylinder 34 is assisted by removing metal from oscillating cylinder 10 at 21 to limit the surface 22 bearing on valve plate 12. Trunnion 13 is made short enough so as not to interfere with the valve seating. 9 and 21 together form a recess, a deep portion and a shallow portion The enlarged portion of trunnion 13 fits into a recess 41 in value plate 12 for greater rigidity. Recess 9 is drilled deep enough into oscillating cylinder 10 so that said cylinder contacts trunnion 13 at the sides only, not at the end of said trunnion. Rescess 35 in oscillating cylinder 10 is drilled to a greater diameter than trunnion 15 so that only the end of trunnion 15 contacts oscillating cylinder 10. This allows the valve faces formed by surface 22 of oscillating cylinder 10 to guide only on valve plate 12, forming a steam tight seal.

If any condensate has accumulated in oscillating cylinder 10, it is expelled automatically as the temporary over pressure caused by the incompressible liquid is relieved by oscillating cylinder 10 momentarily lifting itself away from valve plate 12. No special relief valve is required.

Two or more of the aforementioned systems of the proper dimensions can be used in a compound or multiple expansion arrangement. Opening a passover valve connected across the high pressure stage, allows high pressure steam to be fed to the low pressure stage to start the engine or to increase the power output. Both the throttle and passover valve may be operated as rapidly as desired without external valve leakage.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed as new is as follows:

1. In an oscillating engine comprising: a cylinder capable of oscillating, a first rigid trunnion mounted on a stationary valve plate and supporting one side of said cylinder, fluid supply and exhaust passages connected to said valve plate, said side including a portion slidable on said valve plate and forming therewith valve means, said one side including a recess which opens toward said valve plate, a second trunnion slidable mounted in a support plate and bearing on a side of said cylinder opposite said one side, a coil spring encircling said second trunnion, one end of said spring bearing on a shoulder of said second trunnion and another end of said spring bearing on the support plate, a stationary cylinder connected to said supply passage and having a plunger slidably mounted therein, said plunger extending through one end of said stationary cylinder into engagement with the second trunnion as a result of fluid supplied through said stationary cylinder from said supply passage.

2. An oscillating engine as set forth in claim 1 wherein said comprises a shallow portion and a deep portion, said stationary valve plate also including a recess aligned with said deep portion, an enlarged portion of said first trunnion being received in said deep portion and said stationary valve plate recess between said side and said stationary valve plate, the combined length of said deep portion and said stationary valve plate recess being greater than the length of the enlarged portion received therein preventing end contact of said enlarged portion with said side while permitting side walls of said deep portion to slidably engage sides of said enlarged portion.

* * * * *